US010167883B2

(12) United States Patent
Yoavaphankul

(10) Patent No.: US 10,167,883 B2
(45) Date of Patent: Jan. 1, 2019

(54) APPARATUS FOR CREATING A SWIRLING FLOW OF FLUID

(71) Applicant: Metha Yoavaphankul, Bangkok (TH)

(72) Inventor: Metha Yoavaphankul, Bangkok (TH)

(73) Assignee: Luxnara Yaovaphankul (TH)

( * ) Notice: Subject to any disclaimer, the term of this patent is extended or adjusted under 35 U.S.C. 154(b) by 0 days.

(21) Appl. No.: 15/512,795

(22) PCT Filed: Feb. 3, 2015

(86) PCT No.: PCT/TH2015/000006
§ 371 (c)(1),
(2) Date: Mar. 20, 2017

(87) PCT Pub. No.: WO2016/053207
PCT Pub. Date: Apr. 7, 2016

(65) Prior Publication Data

US 2017/0292545 A1 Oct. 12, 2017

(30) Foreign Application Priority Data

Sep. 29, 2014 (TH) ..... 1401005839

(51) Int. Cl.
*F15C 1/00* (2006.01)
*F15D 1/00* (2006.01)

(52) U.S. Cl.
CPC ..... *F15D 1/0015* (2013.01)

(58) Field of Classification Search
CPC ..... F15D 1/0015; F15D 1/003; F15D 1/004; F15D 1/0045; F15D 1/009
(Continued)

(56) References Cited

U.S. PATENT DOCUMENTS 3,447,383 A * 6/1969 Camarata ..... G01C 19/14 137/809
3,538,775 A * 11/1970 Burke ..... G01C 19/14 137/808
(Continued)

FOREIGN PATENT DOCUMENTS

CN 101749288 6/2010
CN 101876436 11/2010
(Continued)

OTHER PUBLICATIONS

International Search Report for International Application No. PCT/TH2015/000006, dated Jul. 2, 2015.
(Continued)

*Primary Examiner* — Minh Le
(74) *Attorney, Agent, or Firm* — Kim Winston LLP

(57) ABSTRACT

Apparatus or creating a swirling flow of fluid comprises a transmission base with an internal cavity to receive the fluid flow from outside via a side penetrable hole which the longitudinal inner surface of the transmission base will be in shape of slope of continuous line, or slope of line intervals with different degree of slope, or slope of line intervals with at least one bending angle or slope of curve either convex curve or concave curve with at least one curvature to increase or decrease acceleration of swirling flow along the longitudinal internal cavity and in the manner of a laminar swirling flow. And beside the side penetrable hole will become a side hole edge for regulating the flow of fluid to flow inside the transmission base in the manner of a laminar swirling flow in the internal cavity of transmission base which a part of the hole side edge can have an elevated insert shoulder for stacking the attachment to overlay on the insert supporting shoulder of another transmission base stack them higher.

14 Claims, 2 Drawing Sheets

(58) Field of Classification Search
USPC ..... 137/808, 803, 809, 810, 811, 812
See application file for complete search history.

(56) References Cited

U.S. PATENT DOCUMENTS 3,563,260 A * 2/1971 Ellis ..... F15C 1/16 137/810
3,885,931 A * 5/1975 Schaller ..... B04C 3/06 137/812
5,188,868 A * 2/1993 Horii ..... B01J 2/006 118/303
7,267,098 B1 9/2007 Tasanont
8,291,976 B2 * 10/2012 Schultz ..... E21B 43/12 137/811
2003/0221662 A1 12/2003 Wijaya et al.
2008/0060712 A1 * 3/2008 Gluzman ..... B01F 5/0617 138/39
2008/0173363 A1 * 7/2008 Betting ..... B01D 17/045 137/625.28
2012/0097280 A1 * 4/2012 Hallberg ..... B01F 5/0057 137/808
2012/0273297 A1 * 11/2012 Schlosser ..... F01N 1/026 181/213
2012/0285173 A1 * 11/2012 Poyyapakkam ..... F23C 7/004 60/772
2013/0214054 A1 * 8/2013 Faulkner ..... B05B 5/032 239/3
2014/0102572 A1 * 4/2014 Ryon ..... F15D 1/08 137/808
2014/0165578 A1 * 6/2014 Burd ..... F02G 3/00 60/772
2014/0374631 A1 * 12/2014 Sherrit ..... F15D 1/025 251/118
2015/0136261 A1 * 5/2015 Yoavaphankul ..... F15D 1/0015 137/812
2015/0300188 A1 * 10/2015 Feaver ..... F15D 1/0015 415/208.2

FOREIGN PATENT DOCUMENTS

FR 943209 3/1949
TH 1201006816 8/2013
WO 2011009166 1/2011
WO 2014104988 7/2014

OTHER PUBLICATIONS

Written Opinion for International Application No. PCT/TH2015/000006, dated Jul. 2, 2015.

* cited by examiner

APPARATUS FOR CREATING A SWIRLING FLOW OF FLUID

CROSS-REFERENCE TO RELATED APPLICATIONS

This application is a national phase application under 35 U.S.C. § 371 of International Application No. PCT/TH2015/000006 filed Feb. 3, 2015, which claims priority to Thailand Patent Application No. 1401005839 filed Sep. 29, 2014, the entire disclosures of which are hereby incorporated by reference in their entirety.

TECHNICAL FIELD

Engineering related to the apparatus for creating a swirling flow of fluid

BACKGROUND ART

Reference is made to Thai patent number 41173 which discloses an apparatus for creating a swirling flow of fluid comprises a transmission base with an internal cavity to receive the fluid flow from outside via side penetrable hole where a hole side edge is formed. Where in the beginning section of convex curve of the hole side edge has to be the surface with a smallest angle of deviation of the emerging axis of the said penetrable hole, and the said hole side edge has to be the nearest surface to emerging axis of the side penetrable hole to deflect the flow of incoming fluid to the internal cavity of transmission base to flow attaching to the convex curve. It will induce the fluid in the internal cavity to flow to the convex curve resulting in Coanda Effect phenomena, said Coanda Effect will create a laminar flow of fluid along the same plane as an internal surface of transmission base and speed up flow velocity resulting a laminar swirling flow in the internal cavity of the transmission base. A part of the hole side edge can have an elevated insert shoulder to a degree for stacking the attachment to an insert supporting shoulder of another transmission base to stack them higher. The said characteristics of the apparatus for create swirling flow of fluid according to the Thai patent number 41173, the transmission of fluid will generate a constant acceleration of swirling flow in the internal cavity. It is unable to increase the acceleration of swirling flow along the longitudinal internal cavity of the transmission base.

CHARACTERISTICS AND PURPOSE OF THE INVENTION

An apparatus for creating a swirling flow of fluid comprises a transmission base with an internal cavity to receive the fluid flow from outside via side penetrable hole which the longitudinal inner surface of the transmission base will be in shape of slope of continuous line or slop of line intervals with different degree of slope or slope of line intervals with at least one bending angle or slop of curve either convex or concave curve that have at least one curvature to increase or decrease the acceleration of swirling flow in different rate according to the length of inner circumference along the longitudinal internal cavity which is varied in accordance to the said characteristics of the longitudinal inner surface of the transmission base. And the side edge of the side penetrable hole will become side hole edge for introducing the transmission fluid flow to flow into the internal cavity of the transmission base in the manner of laminar swirling flow. Part of the side hole edge can have an elevated insert shoulder to a degree for stacking the attachment to an insert supporting shoulder of another transmission base to stack them higher.

The objective of the present invention is to improve the apparatus for creating swirling flow of fluid according to the Thai patent number 41173, enable it to accelerate the swirling flow along the longitudinal internal cavity and form a laminar swirling flow.

DISCLOSURE OF INVENTION

Figure 1:
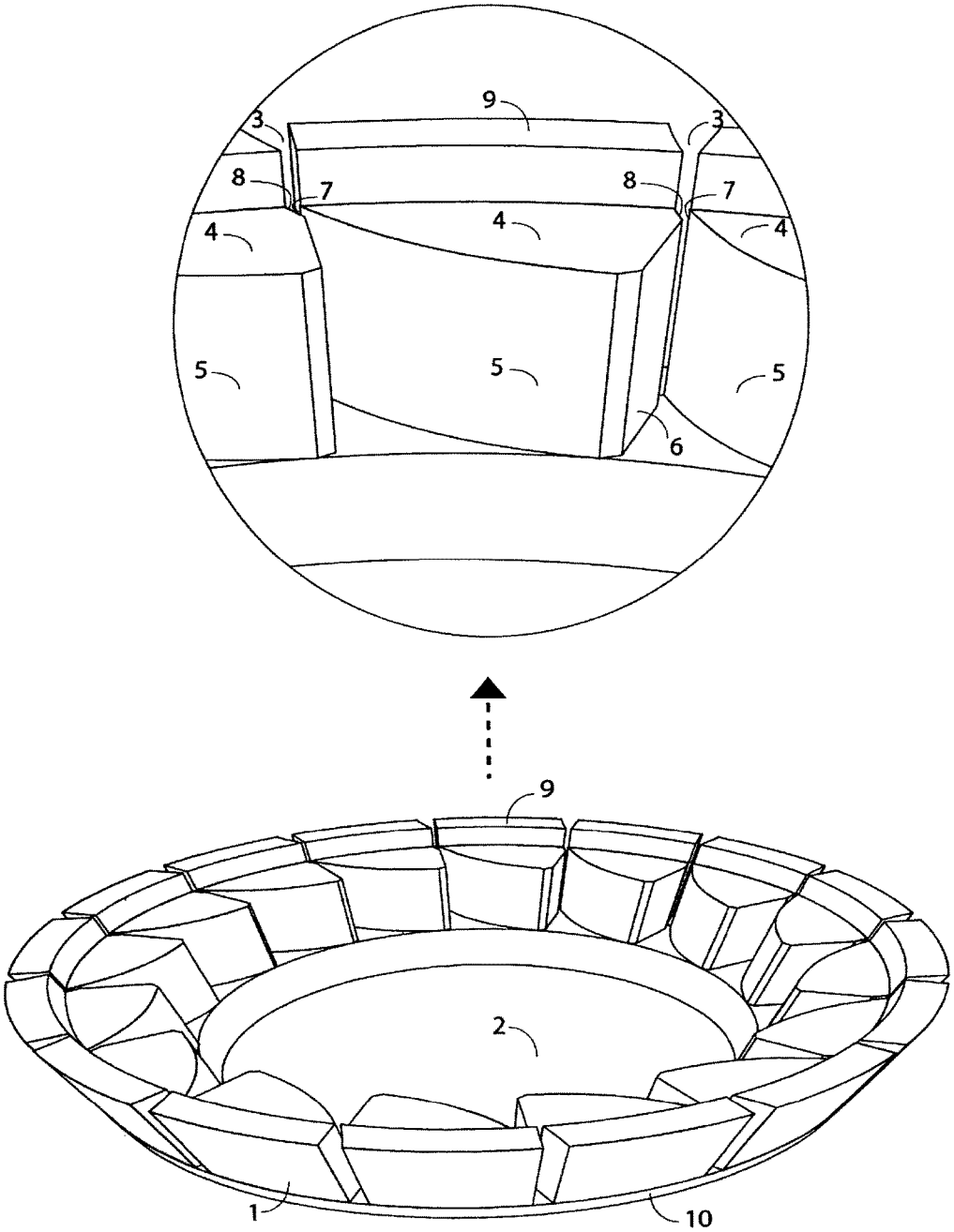
FIG. 1 shows the apparatus for creating swirling flow of fluid of the present invention

According to FIG. 1, the apparatus for creating a swirling flow of fluid of the present invention comprises a certain thickness transmission base 1 with an internal cavity 2 for receiving the fluid flow to create swirl flow inside the internal cavity before flowing out through the outlet or through the structural outlet of the structure that the apparatus for creating swirling flow of fluid is assembled.

The diameter of upper open end of the transmission base 1 is longer than the diameter of lower open end of the transmission base 1 to form a longitudinal inner surfaces of the transmission base 1 which include the convex curve 5 and the other surfaces of the longitudinal surface of transmission base 1 to be in shape of slope of continuous line, with the continuous shortening inner circumference along the slope, to speed up the acceleration of swirling flow along the longitudinal internal cavity 2, and the swirling flow is a laminar swirling flow.

The longitudinal inner surface of the transmission base 1 will be slope of line intervals with different degree of slope or slope of line intervals with at least one bending angle to increase or decrease the acceleration of swirling flow along the longitudinal of the internal cavity 2 in different rate of acceleration according to the length of inner circumference which is varied in accordance to the shape of slope of the longitudinal inner surface of transmission base 1 as said above.

The longitudinal inner surface of the transmission base 1 will be slope of curve either convex curve or concave curve with at least one curvature to increase or decrease the acceleration of swirling flow along the longitudinal internal cavity 2 in different rate of acceleration according to the length of inner circumference which is varied in accordance to the shape of slope of the longitudinal inner surface of transmission base 1, and the swirling flow is a laminar swirling flow.

Side of transmission base 1 will have at least one side penetrable hole 3, which will become at least one hole side edge 4 to regulate the flow through of the fluid from outside of the transmission base 1 to inside of the transmission base 1 in the manner of laminar flow along the plane of inner surface of transmission base 1, which hole side edge 4 is in shape of a shoulder elevated from the transmission base 1, placed beside the side penetrable hole 3, for regulating the fluid flow from outside of the apparatus for creation a swirling flow of fluid.

A part of the surface of the hole side edge 4 is a convex curve 5 for a distance to support the passing fluid to flow in the manner of laminar flow along the same plane of the external surface of the convex curve 5.

Another part of the hole side edge 4 at the opposite side of convex curve 5 is surface 6 for a distance to support the fluid transfer via the side penetrable hole 3 for a better laminar flow along the same plane of the external surface of the convex curve 5.

A part of the convex curve 5, at the inlet of the side penetrable hole 3 can be a concave curve 7 for a distance to assist the outside fluid for a better flow into the side penetrable hole 3 at the side of convex curve 5.

A part of surface 6 at the inlet of the side penetrable hole 3 can be a concave curve 8 for a distance to assist the outside fluid for a better flow into the side penetrable hole 3, which.

The hole side edge 4, wherein the beginning section of convex curve 5 has to be the surface with a smallest angle of deviation of the emerging axis of the side penetrable hole 3, and the surface of hole side edge 4, (convex curve 5) has to be the nearest surface to the emerging axis of the side penetrable hole 3 in comparison with other surfaces surrounding the emerging axis of the side penetrable hole 3 to deflect the flow through of fluid which flow into the internal cavity 2 of the transmission base 1 to flow attaching to the convex curve 5, and induce the fluid in the internal cavity 2 of the transmission base 1 to flow attaching to the convex curve 5, resulting in the Coanda Effect Phenomena. The result of said Coanda Effect will create a laminar flow along the same plane as the internal surface of the transmission base 1 and speed up the flow velocity and create a laminar swirling flow in the internal cavity 2 of the transmission base 1.

Figure 2:
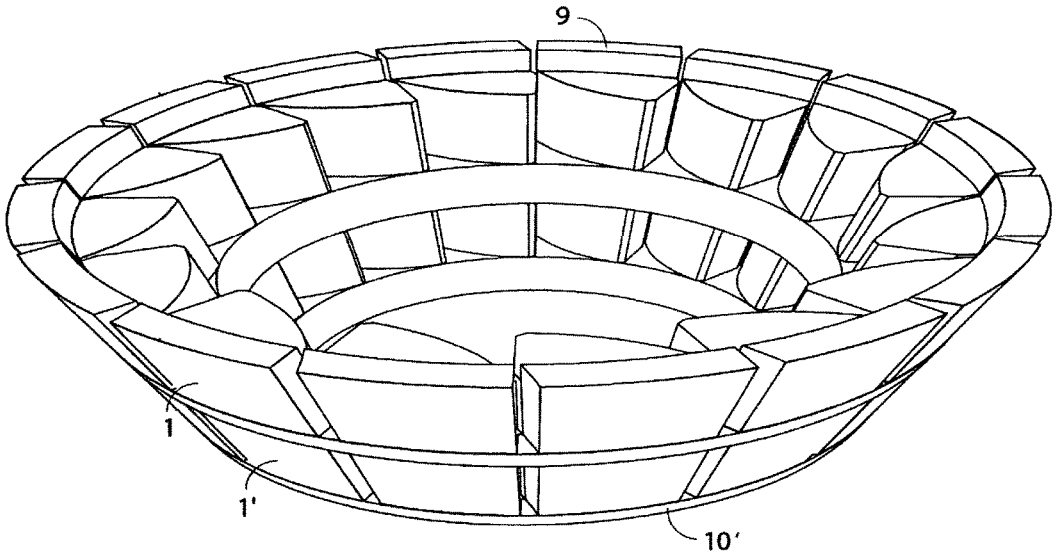
FIG. 2 shows the assembling of the apparatus for creating swirling flow of fluid of the present invention.

A part of the hole side edge 4 in which at least one rim can have an elevated insert supporting shoulder 9 to support the overlay attachment of another transmission base to stack them higher (as shown in FIG. 2).

A part of the transmission base 1 can have an elevated insert shoulder 10 to a degree for stacking the attachment to an insert supporting shoulder 9 of another transmission base to stack them higher (as shown in FIG. 2).

According to FIG. 2, a stacking attachment of apparatus for creating a swirling flow of fluid of the present invention which comprises the transmission base 1 with an insert shoulder 10 to overlay on the insert support shoulder 9 of another transmission base 1' to extend the length of the apparatus for creating a swirling flow of fluid.

According to the apparatus for creating a swirling flow of fluid of the present invention, the longitudinal inner surface of transmission base 1 is in shape of slope of a continuous line, or slope of line intervals with differed degree of slope or slope of line intervals with at least one bending angle or in shape of slope of a curve either convex curve or concave curve with at least one curvature to increase or decrease the acceleration of swirling flow along the longitudinal internal cavity 2 in different rate of acceleration according to the length of inner circumference which is varied in accordance to the shape of slope of the longitudinal inner surface of transmission base 1 as described above.

BEST MODE FOR CARRYING OUT THE INVENTION

As the same as mention in Disclosure of Invention.

The invention claimed is:

1. An apparatus for creating a swirling flow of fluid comprising:

a transmission base with an internal cavity the transmission base including:

a side penetrable hole, a hole side edge with a convex curve which is part of an inner surface of the transmission base to deflect a flow with Coanda Effect to create a laminar swirling flow in the internal cavity, wherein a diameter of an upper open end of the transmission base is longer than a diameter of a lower open end of the transmission base to form a longitudinal surface of the transmission base which includes the convex curve and another surface of the longitudinal inner surface of the transmission base to be in a shape of a slope of a continuous line, with a continuous shortening of an inner circumference along the slope of a continuous line to speed up an acceleration of swirling flow along the internal cavity in a manner of a laminar swirling flow.

2. The apparatus of claim 1, wherein the convex curve extends inwardly from an inner surface of the transmission base.

3. The apparatus of claim 1, wherein the transmission base includes a plurality of side penetrable holes and a plurality of convex curves each adjacent a respective side penetrable hole of the plurality of side penetrable holes.

4. The apparatus of claim 3, wherein the plurality of convex curves substantially defines a generally frustoconical inner surface of the transmission base.

5. The apparatus of claim 3, wherein each of the plurality of convex curves are circumferentially spaced apart.

6. The apparatus of claim 1, wherein the side penetrable hole is an elongated hole that extends a length of about a vertical length of the convex curve.

7. The apparatus of claim 1, wherein the transmission base further includes an elevated insert supporting shoulder adjacent the convex curve.

8. The apparatus of claim 1, wherein the transmission base further includes an insert shoulder adjacent the convex curve.

9. An apparatus for creating a swirling flow of fluid comprising:

a transmission base with an internal cavity, the transmission base including:

a side penetrable hole, a hole side edge with a convex curve which is part of an inner surface of the transmission base to deflect a flow with Coanda Effect to create a laminar swirling flow in the internal cavity, wherein a longitudinal inner surface of the transmission base includes the convex curve and other surfaces of the longitudinal inner surface, the transmission base comprising partly in a shape of a slope of continuous line and in a shape of a slope of curve either convex curve or concave curve with at least one curvature to increase or decrease an acceleration of the swirling flow in a different rate of acceleration along the internal cavity according to a length of an inner circumference which is varied in accordance with a shape of slope of the longitudinal inner surface of the transmission base.

10. An apparatus for creating a swirling flow of fluid comprising:

a transmission base with an internal cavity, the transmission base including:

a side penetrable hole, a hole side edge with a convex curve which is part of an inner surface of the transmission base to deflect a flow with Coanda Effect to create a laminar swirling flow in the internal cavity, wherein a longitudinal inner surface of the transmission base which includes the convex curve and other surfaces of the longitudinal inner surface of the transmission base is in a shape of slope of line intervals with different degrees of slope of line intervals with at least one bending angle to increase or decrease acceleration of the laminar swirling flow in a different rate of acceleration along the internal cavity according to a length of an inner circumference of the transmission base which is varied in accordance to a shape of slope of the longitudinal inner surface of the transmission base.

11. The apparatus of claim 1, wherein the first transmission base is frustoconical shaped, and the second transmission base is frustoconical shaped and stackable on the first transmission base such that the stacked first and second transmission bases define a substantially frustoconical shape, and wherein each of the first and second transmission bases include a plurality of side penetrable holes and a plurality of convex curves each adjacent a respective side penetrable hole of the plurality of side penetrable holes.

12. The apparatus of claim 11, wherein each of the first and second transmission bases include an elevated insert supporting shoulder adjacent the convex curve and an insert shoulder adjacent the convex curve, and wherein the insert shoulder of the first transmission base matingly engages the elevated insert supporting shoulder of the second transmission base when stacked.

13. The apparatus of claim 11, wherein each convex curve of the first and second transmission bases extends inwardly from an inner surface of respective first and second transmission bases.

14. The apparatus of claim 11, wherein each of the plurality of convex curves of the first transmission base are circumferentially spaced apart and each of the plurality of convex curves of the second transmission base are circumferentially spaced apart.

* * * * *